US007536884B2

(12) United States Patent
Ho

(10) Patent No.: US 7,536,884 B2
(45) Date of Patent: May 26, 2009

(54) IDENTIFICATION/SURVEILLANCE DEVICE WITH REMOVABLE TACK BUTTON

(75) Inventor: Wing K. Ho, Boynton Beach, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 157 days.

(21) Appl. No.: 10/983,152

(22) Filed: Nov. 5, 2004

(65) Prior Publication Data

US 2006/0097872 A1 May 11, 2006

(51) Int. Cl.
*E05B 65/00* (2006.01)

(52) U.S. Cl. ..... 70/57.1; 24/704.1

(58) Field of Classification Search ..... 70/57.1, 70/276; 24/704.1, 150 R, 150 P, 155 BR; 340/572, 574

See application file for complete search history.

(56) References Cited

U.S. PATENT DOCUMENTS 3,974,581 A 8/1976 Martens et al.
3,995,900 A * 12/1976 Humble et al. ..... 70/57.1
4,502,717 A * 3/1985 Close ..... 70/57.1
4,531,264 A 7/1985 Minasy
4,944,075 A 7/1990 Hogan
5,031,287 A * 7/1991 Charlot et al. ..... 24/704.1
5,426,419 A * 6/1995 Nguyen et al. ..... 340/572.9
5,955,951 A 9/1999 Wischerop et al.
6,029,322 A 2/2000 Belotti et al.
6,255,950 B1 7/2001 Nguyen
6,722,166 B2 * 4/2004 Skjellerup ..... 70/57.1

OTHER PUBLICATIONS

EPO International Search Report and Written Opinion dated Nov. 15, 2006 for corresponding appln PCT/US05/040422.

* cited by examiner

*Primary Examiner*—Suzanne D Barrett

(57) ABSTRACT

An identification/surveillance device including a tag portion and a tack. The tack includes a button and a pin having a dull end and a sharp end. The identification/surveillance device is secured to an article to be identified/surveilled by inserting the pin through the article and engaging the pin with the tag portion. The dull end of the pin is releasably engaged with either the button or the tag portion such that when the identification/surveillance device is removed from the article the sharp end of the pin remains engaged with either the tag portion or the button and only the dull end of the pin is exposed.

17 Claims, 4 Drawing Sheets

IDENTIFICATION/SURVEILLANCE DEVICE WITH REMOVABLE TACK BUTTON

FIELD

The present disclosure is directed at article identification and surveillance systems, and is more particularly directed at removable article identification and surveillance systems.

BACKGROUND

A variety of article identification and/or surveillance systems are known, for example for the prevention or deterrence of unauthorized removal of articles from a controlled area such as a retail establishment. Often, article identification/surveillance systems include a tag that is removably secured to an article, such as merchandise, etc, to be identified and/or monitored. The tag may be removed or deactivated prior to authorized removal of the article from the controlled area. Upon unauthorized removal the tag may activate an alarm. For example, some identification/surveillance tags or devices may be designed to cause an alarm through interaction with an electromagnetic field established at the exits of the controlled area. Other varieties of tags may be designed to release a dye, for example onto an article, if the tag is forcibly removed.

The use of identification/surveillance tags is very popular amongst soft goods retail establishments to reduce shrinkage primarily due to shoplifting. One variety, called hard tags, includes a hard or rigid plastic tag body that is typically attached to soft goods, such as garments, using a tack. The tack may include a button having a pin extending from one side of the button. The end of the pin extending from the button is sharp to allow insertion of the pin into fabric/material of the items to be tagged without damaging the items. The button may be configured with sufficient size to prevent someone from forcing the fabric past the button to defeat the identification/surveillance system. According to different designs, the tack construction can include a plastic button that is molded around a metal pin. In other designs, the tack is constructed similar to a thumbtack in which the pin and button are a unitary structure.

The pin of the tack may be inserted through the article and into the tag body to affix the tag to the article for identification/surveillance. The tag may include a clutch or a clamp that captures the pin, thereby preventing unauthorized removal of the tag from the article. The clamp or clutch of the tag may be opened using a specially configured apparatus. In addition to the clamp or clutch, the tag may also house a sensor element to be detected by EAS (electronic article surveillance) detectors. Other variations include ink tags, which may release a permanent ink onto the article if the tag is forced open, and keepers, which may include a cable or wire connected to a stationary structure to physically prevent removal of the article. Once the clamp or clutch has been opened the tack may be removed from the tag, thereby allowing the tag to be removed from the article.

One problem often encountered with article identification/surveillance devices used for soft goods is the hazard associated with the sharp pin. When the tag is attached to the item, the pin is received within the tag, and the sharp end of the pin is not exposed and does not pose any hazard. When the tag is detached, however, the tack is removed from the tag, and the sharp pin is exposed. The exposed sharp pin of the loose tack creates hazard to store clerks, such as during and after removal of the tag, and to customers, for example if it is inadvertently left in the item. With increasing frequency, stores are also offering self-checkout in which the customer scans and pays for items without the assistance of a store clerk. The new application of self-checkout further exposes customers to hazards if the customers also detach the tag and handle the loose tack without the benefit of proper training.

In addition to the hazard presented by the pin, another drawback that is often encountered with identification/surveillance tags using a tack to secure the tag to an article is difficult removal of the tack from the tag. Commonly, the tack is separated from the tag body. Removal of tack may require some amount of force to slip the pin out of the gripping material of the tag clamp. Additionally, a long pin, which may be used for tagging thicker items, may be caught on the surrounding material of the tagged item or may not be fully removed from the item during the detaching process. These problems may hamper attempts at automatic tag removal. These problems may further complicate the incorporation of self-checkout stations in retail establishments. This further complication is, at least in part, due to the fact that customers using self-checkout stations must remove the identification/surveillance tags without the benefit of any extensive training or explanation.

BRIEF DESCRIPTION OF THE DRAWINGS

Features and advantages of the claimed subject matter will be apparent from the description of embodiments consistent therewith, which description should be considered in combination with the accompanying drawings, wherein:

DESCRIPTION

Figure 1:
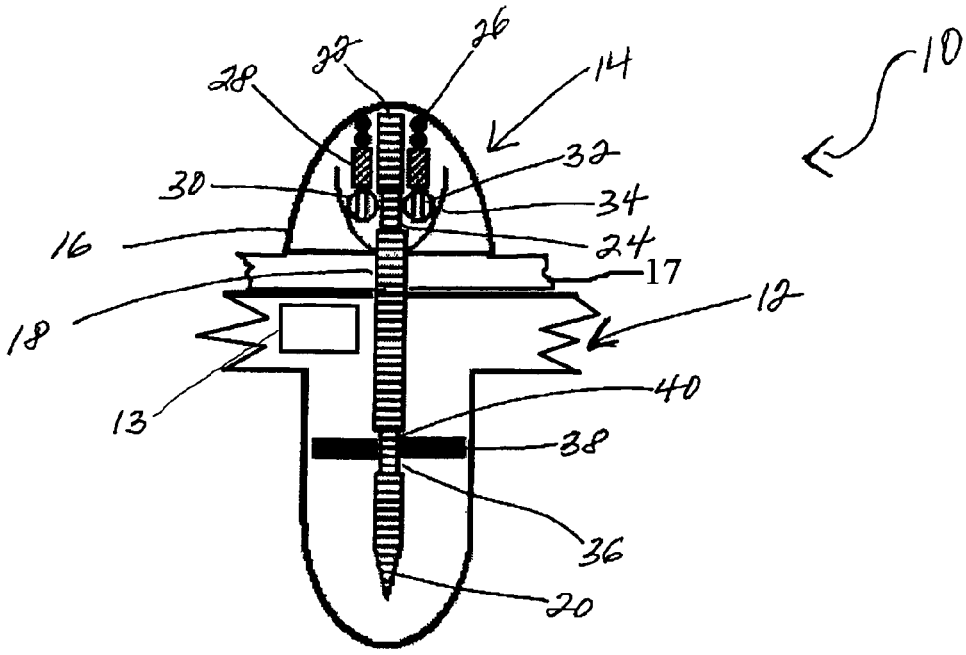
FIG. 1 is a schematic cross-sectional view of an embodiment of an identification/surveillance device consistent with the present disclosure.

Referring to FIG. 1, there is illustrated a cross-sectional view of a portion of an identification/surveillance device 10 consistent with the present disclosure. The illustrated identification/surveillance device 10 generally includes a tag 12 and a tack 14. The tag 12 may include a detection/marking feature 13. The detection/marking feature 13 may include, for example, an electronic article surveillance (EAS) device, e.g., an RFID; a marking device; etc. The detection/marking feature 13 may be provided in portions of the tag 12 other than the illustrated location. The tack 14 may generally include a button 16 and a pin 18. The pin 18 may be engaged with the button 16, and may be inserted through an article 17 to be identified or surveilled. The pin 18 may have a sharp or pointed end 20 to facilitate insertion of the pin 18 through an article to be identified or surveilled. The sharp or pointed end 20 of the pin may be at least partially received in the tag portion 12 and may be engaged by the tag 12. Accordingly, the article to be identified or surveilled may be captured between the button 16 and the tag 12, with the pin 18 extending through the article 17, as shown.

In the illustrated exemplary embodiment, the pin 18 is releasably engaged to the button 16 using magnetic ball clutch. As shown, the ball clutch may be disposed around a portion of the pin 18 received in the button 16. The magnetic ball clutch may include a coil spring 26. The coil spring 26 may act against a ferrous plunger 28, and bias the ferrous plunger 28 axially relative to the pin 18 towards the pointed end 20 of the pin 18. In one embodiment, the ferrous plunger 28 may be configured as an annular feature disposed coaxially around the pin 18 in an assembled configuration, as shown in FIG. 1. The ferrous plunger 28 may in turn act on one or more ball bearings 30, 32, thereby biasing the ball bearings 30, 32 toward a converging surface 34. Consistent with such a configuration, the pin 18 may include a radial groove 24 around at least a portion of the circumference of the pin 18. The force of the ferrous plunger 28 biasing the ball bearings 30, 32 against the converging surface 34 may urge the ball bearings 30, 32 toward the pin 18, such that the ball bearings 30, 32 may engage the groove 24 in the pin 18. When the ball bearings 30, 32 are engaged in the groove 24 of the pin 18, the pin 18 may resist being removed or separated from the button 16.

The button 16 may be detached from the pin 18 using a magnet to overcome the biasing force of the spring 26. The magnet may be brought into proximity to the button 16 from above, i.e., on the side of the button 16 adjacent to the spring 26. The magnet may attract the ferrous plunger 28, thereby compressing the spring 26 and relieving the biasing force on the ball bearings 30, 32. With the biasing force 30, 32 relieved, the ball bearings 30, 32 may release from the groove 24 in the pin 18, thereby permitting the pin 18 to be separated from the button 16.

Numerous variations of the above-described magnetic ball clutch are possible. For example, spring configurations other than the illustrated coil spring 26 may suitably be employed for biasing the ferrous plunger 28. Similarly, rather than one or more ball bearings 30, 32, a segmented ring, etc., may be biased to capture the pin 18. Still further alternatives and variations of the illustrated magnetic ball clutch may be suitably employed herein.

In addition to being releasably engageable to the button 16, the pin 18 may also be engageable with the tag portion 12. According to one embodiment, the tag portion 12 may be configured to engage the tack 14 in a non-releasable manner, or in a manner that is not readily releasable. Referring to the embodiment shown in FIG. 1, the tag portion 12 may include a clamp 38 configured to capture the pin 18. The pin 18 may be provided including a second radial groove 36 extending around at least a portion of the circumference of the pin 18. As shown, the second groove may be disposed on a portion of the pin 18 adjacent to the pointed end 20 of the pin. The clamp 38 may engage the second groove 36 of the pin 18 to resist removal of the pin 18 from the tag portion 12.

According to one embodiment, the clamp 38 may include an opening 40 having an inside diameter smaller than the outside diameter of the pin 18 and the clamp 38 may be sized to be at least partially received in the second groove 36 of the pin 18. The pointed end 20 of the pin 18 may be pressed into the opening 40 and the taper of the pointed end 20 may cause the opening to elastically expand to accept the pin 18. When the pin 18 is pressed into the opening 40 far enough to align the second groove 36 in the pin with the clamp 38, the opening 40 may elastically recover into the second groove 36. According to one embodiment, the second groove 36 may be formed having a stepped or steeply inclined profile adjacent the pointed end 20 of the pin 18. The stepped or steeply inclined profile may provide limited mechanical advantage for elastically deforming the opening 40 to permit extraction of the pin 18 from the clamp 38. Accordingly, the clamp 38 may resist facile removal of the pin 18.

Consistent with the foregoing embodiment, the clamp 38 may be formed from any material that may permit sufficient elastic deformation and recovery to allow the pin 18 to be pressed into the opening 40 and to elastically recover to engage features on the pin 18. For example, the clamp 38 may be formed from an elastomeric material, such as natural rubber, a polymeric material, etc. It is not necessary, however, that all of the deformation of the clamp 38 be within the elastic limits of the material of the clamp 38. Additionally, features other than a groove and opening may be used to non-releasably engage the pin 18 to the tag portion 12. The clamp may include one or more elastically deformable features. For example, the clamp may include a metallic member, such as a piece of sheet metal, including an opening therein and at least one spring finger extending into the opening. The spring finger may elastically deflect when the pin is inserted through the opening, and may elastically recover to engage a groove in the pin. Similarly, the pin may include engagement features other than a groove. For example, the pin may include barbs, protrusions, etc. configured to cooperate with the engagement features of the tag.

Consistent with one embodiment, the pin 18 and the button 16 may be pre-assembled to provide a tack 14 having a pointed end 20. The identification/surveillance device 10 may be attached to an article by inserting the pointed end 20 of the pin 18 through the article. The tag portion 12 may be pressed onto the pointed end 20 of the pin 18. The pin 18 may be pressed into the tag portion 12 until the clamp 38 of the tag portion 12 engages the pin 18. Similarly, the tack 14 may be pressed into the tag portion 12. For example, at least a portion of the article to be identified/surveilled may be placed over the tag portion 12. The pointed end 20 of the pin 18 may be aligned with an opening in the tag portion 12 providing access to the clamp 38. The tack 14 may be pressed into the tag portion 12 until the clamp 38 engages the pin 18. In this manner, the identification/surveillance device 10 may be securely engaged to the article with the enlarged button 14 and tag portion 12 preventing the removal of the identification/surveillance device 10 from the article.

Consistent with the present disclosure the pin 18 may be releasably engaged to the button 16 of the identification/surveillance device 10. In this manner, identification/surveillance system 10 herein may be released or removed from an item by releasing the pin 18 from the button 16. Consistent with such an embodiment, the pin 18 may remain engaged in the tag portion 12 and the button 16 may be separated from the remainder of the device. As shown, the end 22 of the pin 18 releasably engaged by the button 16 may be blunt or dull, and therein configured to minimize the pricking hazard of the pin 18, as compared to the sharp or pointed end 20 of the pin 18. For example, according to various embodiments, the end 22 of the pin 18 may be flat, rounded, etc. Accordingly, when the identification/surveillance device 10 is removed from an article by disengaging the button 16 from the pin 18, the sharp end 20 of the pin 18 is engaged in the tag portion 12 and only the dull end 22 of the pin 18 is exposed. In this manner, the pricking hazard associated with the removal of the identification/surveillance device 10 may be reduced. As used in any embodiment herein the terms sharp or pointed and the terms blunt or dull indicate a configuration of opposed ends of the pin relative to one another, rather than an absolute or particular structure or geometry. In one embodiment, for example, the sharp or pointed end may have an end surface area that is smaller than an end surface area of the blunt or dull end, or the sharp or pointed end may have a smaller end radius of curvature than the blunt or dull end.

Consistent with one aspect, the simplified removal of the identification/surveillance device 10 and the reduced pricking hazard may facilitate economic use of identification/surveillance systems. For example, the facile removal of the identification/surveillance device 10 and the reduced pricking hazard may reduce the extent of training necessary for the safe and efficient removal of the identification/surveillance device. Additionally, the ease of removal of the identification/surveillance device 10 and the reduction in the pricking hazard may also make the identification/surveillance device 10 consistent with the present disclosure more suitable for use by untrained customers in the context of self-checkout stations in retail establishments. Furthermore, removal of the button alone, as opposed to the complete tack, may be more conducive to automatic removal. For example, removal of the button alone may reduce, or eliminate, the problems that may arise from the pin of the tack becoming entangled in the article or a free tack presenting a pricking hazard.

Figure 2:
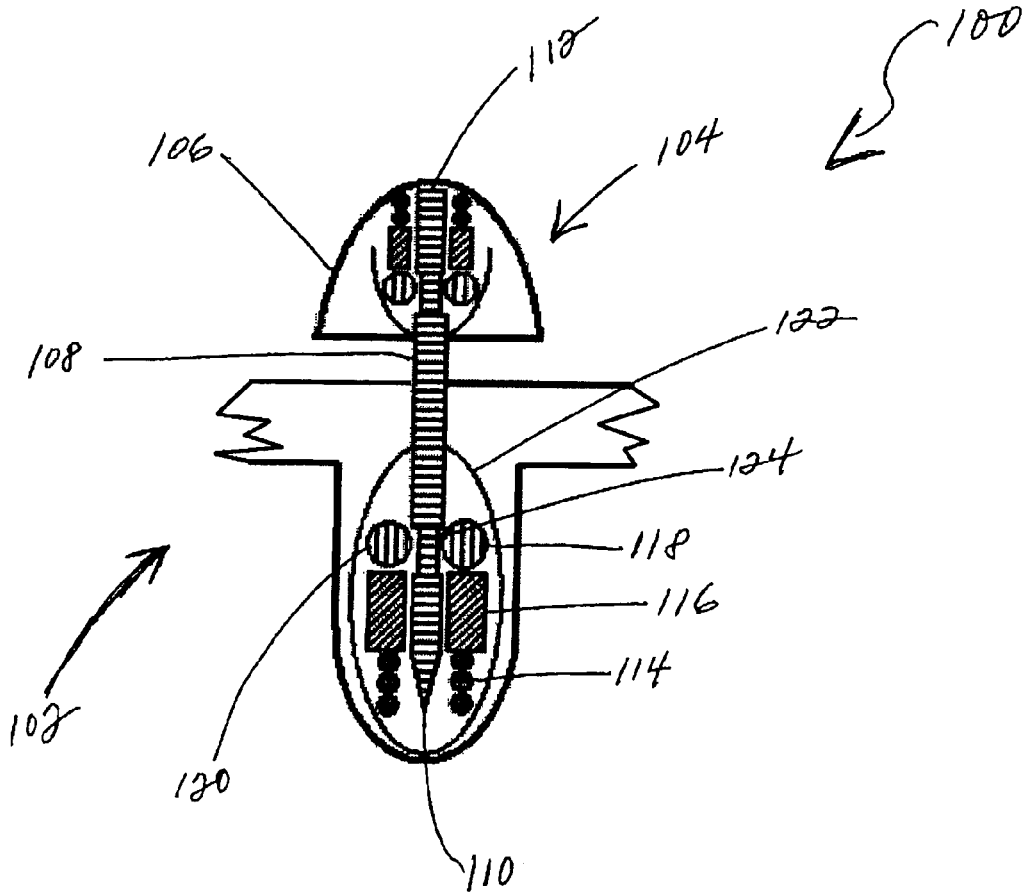
FIG. 2 is schematic cross-sectional view of another embodiment of an identification/surveillance device consistent with the present disclosure.

FIG. 2 illustrates another embodiment of an identification/surveillance device 100 consistent with the present disclosure. As illustrated, the identification/surveillance device 100 may include a tag portion 102 and a tack 104. The tack 104 may include a button 106 and a pin 108. Similar to the previous embodiment, the pin 108 may include a sharp end 110 engageable with the tag portion 102, and a dull end 112 engageable with the button 106. The sharp end 110 of the pin 108 may be configured to permit facile penetration of articles to be identified/surveilled. The dull end 112 of the pin 108 may be releasably engageable with the button 106, and may, as such, be configured to reduce a pricking hazard as compared to the sharp end 110 of the pin 108. Consistent with the illustrated embodiment, the button 106 may include a magnetic ball clutch, or similar arrangement, for releasably engaging the dull end 112 of the pin 108.

The identification/surveillance device 100 shown in FIG. 2 includes a tag portion 102 that is configured for releasably engaging the sharp end 110 of the pin 108. Consistent with the illustrated embodiment, the tag portion 102 may utilize a magnetic ball clutch or similar arrangement for releasably engaging the sharp end 110 of the pin 108. Similar to the arrangement of the button 106, the magnetic ball clutch in the tag portion 102 may generally include a coil spring 114. The coil spring 114 may bias a ferrous plunger 116 toward the button 106, generally along the axis of the pin 108. The ferrous plunger 116 may be generally configured as a ring of a ferrous material, although other configurations may also suitably be employed herein. The ferrous plunger 116 may act against one or more ball bearings 118, 120 pressing the ball bearings 118, 120 against a converging surface 122. The force of the ball bearings 118, 120 against the converging surface 122 may urge the ball bearing together.

The pin 108 may be inserted into the magnetic ball clutch assembly of the tag portion 102 by pressing the sharp end 110 of the pin into an opening in the tag portion 102 and in between the ball bearings 118, 120. Inserting the pin 108 into the magnetic ball clutch in such a manner may compress the spring 114 by applying a compressive force on the spring through the ball bearings 118, 120 and ferrous plunger 116. When the spring 114 is compressed the ball bearings 118, 120 may move away from the converging surface 122, thereby permitting the ball bearings 118, 120 to move away from one another sufficiently to permit the pin 108 to move in between the ball bearings 118, 120.

The pin 108 may further include a radial groove 124. When the groove 124 aligns with the ball bearings 118, 120 the compressive force applied by the pin 108 may be reduced allowing the spring 114 to urge the ball bearings 118, 120 against the converging surface 122, thereby also urging the ball bearings 118, 120 together to engage the groove 124 of the pin 108. When the ball bearings 118, 120 engage the groove 124 of the pin 108, the magnetic ball clutch may resist removal of the pin 108 from the tag portion 102.

Consistent with the foregoing, the dull end 112 of the pin 108 may be pre-assembled to the button 106 to provide a complete tack 104. The identification/surveillance device 100 may be secured by pushing the sharp end 110 of the pin 108 through an article to be identified/surveilled and into the magnetic ball clutch of the tag portion 102. The sharp end 110 of the pin 108 may be engaged by the magnetic ball clutch of the tag portion 102 in the above-described manner.

Similar to the exemplary embodiment of FIG. 1, the identification/surveillance device 100 may be removed from an article by bringing a magnet into proximity with the button 106, thereby unlocking the magnetic ball clutch in the button 106 and allowing the dull end 112 of the pin 108 to be released from the button 106. The tag portion 102 and the pin 108 may then be removed from the article without exposing the sharp end 110 of the pin 108. Subsequently, the pin 108 may be disengaged or released from the tag portion 102. Accordingly, the tag portion 102 and/or the pin 108 may be readily susceptible to reuse.

Again, the ball clutch is susceptible to numerous modifications and variations without materially departing from principles thereof. For example, the spring 114 may have a configuration other than as a coil spring. Similarly, the design and configuration of the ferrous plunger and ball bearings may be altered and/or varied as previously discussed.

In another configuration the tag portion may include ball clutch that is configured to be non-disengageable. A ball clutch according to this embodiment may be generally as described with reference to FIG. 2. The ferrous plunger, however, may be replaced with a non-ferrous plunger. In such a configuration, the ball clutch may be engaged by inserting the sharp end of the pin into the clutch. However, the non-ferrous plunger cannot be urged to compress the spring using a magnet. Therefore, once the sharp end of the pin is engaged in the ball clutch, the pin may become non-releasably engaged to the tag portion.

Figure 3:
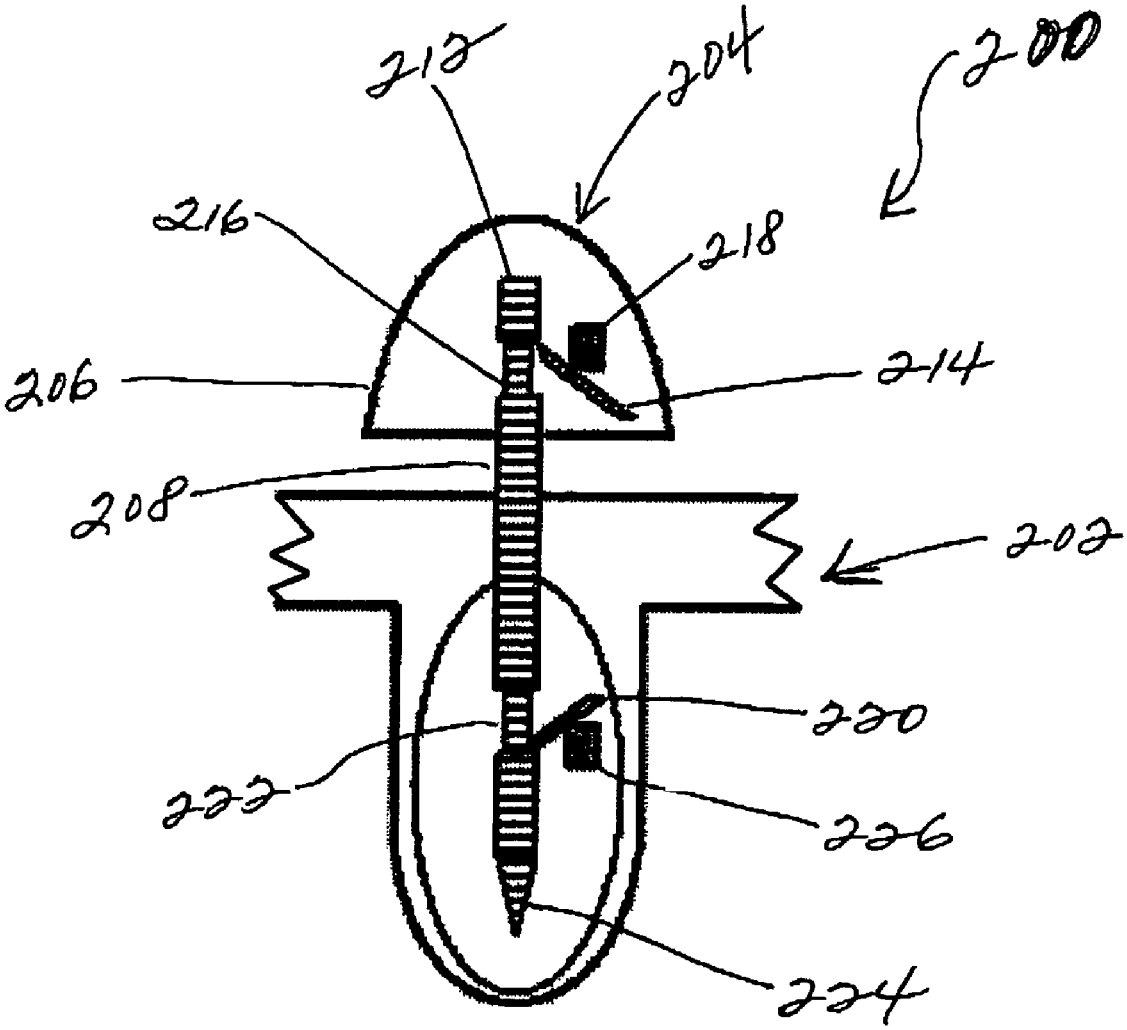
FIG. 3 is a schematic cross-sectional view of yet another embodiment of an identification/surveillance device consistent with the present disclosure.

Turning to FIG. 3, a cross-sectional view of another embodiment of an identification/surveillance device 200 consistent with the present disclosure is shown. As with the preceding embodiments, the identification/surveillance device 200 may generally include a tag portion 202 and a tack portion 204. The tack portion 204 may generally include a button 206 and a pin 208 configured to be releasably engaged to the button 206. The pin 208 may have a sharp or pointed end 210 that may be configured to be engaged with the tag portion 202. The pin 208 may also have a dull end 212 that is configured to be releasably engageable with the button 206.

Consistent with the illustrated embodiment, the button 206 may include a magnetically releasable clutch including a locking member 214. The locking member 214 may be configured to engage a radial groove 216 in the pin 208. As depicted, when the locking member 214 is disposed in the radial groove 216 of the pin 208, the locking member 214 may resist withdrawal of the pin 208 from the button 206. The locking member 214 may be maintained in a desired position and/or orientation within the button 206 by a compressible foam member 218, or other similar resiliently deformable member. Consistent with the illustrated embodiment, a dull end 212 of the pin 208 may be inserted into the button 206.

During insertion of the pin 208 into the button 206, the dull end 212 of the pin 208 may contact the locking member 214. The compressible foam member 218 may deform and allow the locking member 214 to rotate or pivot away from the pin 208. When the pin 208 is inserted into the button 204 so that the groove 216 of the pin 208 aligns with the locking member 214, the locking member 214 may rotate or pivot toward the pin 208 and engage the groove 216, under the biasing force of the compressible foam member 218.

As illustrated, the tag portion 202 of the identification/surveillance device 200 may also include a magnetic clutch similar to the magnetic clutch associated with the button 206. As such, the tag portion 202 may include a locking member 220 configured to be engageable with a groove 222 in pin 208 adjacent to a sharp or pointed end 224 of the pin 208. The locking member 220 may be supported in a desired position and/or orientation by a compressible foam member 226, or similar resiliently deformable member. As described with reference to the clutch associated with the button 206, when the pin 208 is inserted into the clutch mechanism of the tag portion 202, the locking member 220 may pivot or rotate away from the pin 208. When the groove 222 of the pin 208 aligns with the adjacent portion of the locking member 220, the locking member 220 may rotate or pivot into the groove 222 under a biasing force provided by the foam member 226. When the locking member 220 is engaged in the groove 222 of the pin 208 the locking member may resist withdrawal of the pin 208 from the tag portion 202.

The pin 208 may be preassembled to the button 204 to provide a tack 204 including the pin 208 engaged with the button 206. The pin 208 may be inserted through an article to be identified/surveilled and into the tag portion 202 until the pin 208 is engaged by the clutch of the tag portion 202. In this manner the identification/surveillance device 200 may be secured to the article.

The identification/surveillance device 200 may be released from the article by disengaging the magnetic clutch in the button 206 from the pin 208. Consistent with the illustrated embodiment, the magnetic clutch in the button 206 may be disengaged from the pin 208 by moving a magnet with sufficient field strength and the right direction proximate the button 206. The locking member 214 may be formed from a ferrous material. The magnet may, therefore, cause the locking member 214 to pivot or rotate out of the groove 216 in the pin 208. With the locking member 214 rotated out of the groove 216, the pin 208 may be extracted from the button 206, thereby leaving the blunt or dull end 212 of the pin 208 exposed. The pin 208 may remain engaged with the tag portion 202 and may be extracted from the article by removing the tag portion 202 from the article. The pin 208 may subsequently be removed from the tag portion 202 by providing the locking member 220 formed from a ferrous material, and using a magnet to pivot or rotate the locking member 220 out of the groove 222 adjacent the tapered or sharp end 224 of the pin 208, in a manner similar to the disengaging the magnetic clutch in the button 206. Accordingly, the button 206, pin 208, and/or tag portion 202 may be reused.

In a related embodiment, the clutch mechanism associated with the tag portion may be adapted to non-releasably engage the pin. For example, the locking member of the clutch in the tag portion may be formed from a non-ferrous material. Accordingly, once the locking member is engaged with the groove adjacent the sharp end of the pin, the locking member cannot be disengaged using a magnet. Alternatively, a magnetic shielding material may be positioned around the locking member. The shielding material may reduce the influence of an external magnetic field on the locking member. Various other configurations may also be used to provide non-releasable between the pin and the clutch in the tag portion.

In the illustrated embodiments of FIGS. 2 and 3, in which the pin is releasably engageable with both the button and the tag portion, the same releasable engagement mechanism is used for both the button and the tag portion. According to alternative embodiments, the releasable engagement mechanism configured to releasably engage the pin to the button may be different from the releasable engagement mechanism configured to releasably engage the pin to the tag portion. For example, with reference to the two illustrated exemplary clutch mechanisms, the pin may be releasably engaged to the button using a magnetic ball clutch mechanism. A magnetic clutch mechanism as shown in FIG. 3, however, may be employed for releasably engaging the pin to the tag portion. Various alternative releasable, and non-releasable, engagement mechanisms may be used for engaging the pin to the button and/or to the tag portion of the identification/surveillance system.

Furthermore, while the illustrated embodiments of FIGS. 1 through 3 have been directed to identification/surveillance devices configured having the button of the tack releasably engageable with the pin, this configuration may also be modified consistent with the present disclosure. For example, a dull end of the pin may be releasably engageable with the tag portion and a sharp or pointed end may be engageable with the button. According to such a configuration, the dull end of the pin may be engaged with the tag, thereby leaving the sharp end of the pin extending from the tag. The sharp end of the pin may be inserted through an article to be identified/surveilled. The button may then be pressed onto the sharp end of the pin so that the button covers the sharp end and engages the pin. The identification/surveillance device may be removed from the article by releasing the engagement between the tag and the pin, whereupon the tack, including the pin and the button, may be removed from the article. In such an embodiment, while the tack is removed as a complete unit, i.e., including the pin and the button, the exposed end of the pin is dull, thereby reducing the pricking hazard associated with the tack. According to various embodiments, the pin may be releasably engageable with the button or non-releasably engageable with the button.

According to another aspect, the tag may be configured having a recess extending from the clamp or clutch. Consistent with such a configuration, after the button has been released or disengaged from the blunt end of the pin, the pin may be pushed into the recess extending from the clamp or clutch of the tag. Accordingly, once the pin has been pushed into the recess, the pricking hazard associated with the pin may be even further reduced. In one embodiment consistent with this aspect, a detaching mechanism may be provided to both release the button from the blunt end of the pin and to push the pin into the recess of the tag. According to one particular embodiment, the detaching mechanism may release the button and may push the pin through the article and into the recess, for example using a moveable drift, etc. In such an embodiment, when the identification/surveillance device is separated from the article, the pin may be at least partially, if not completely, disposed within the tag, thereby further reducing any pricking hazard associated with the pin.

Figure 4:
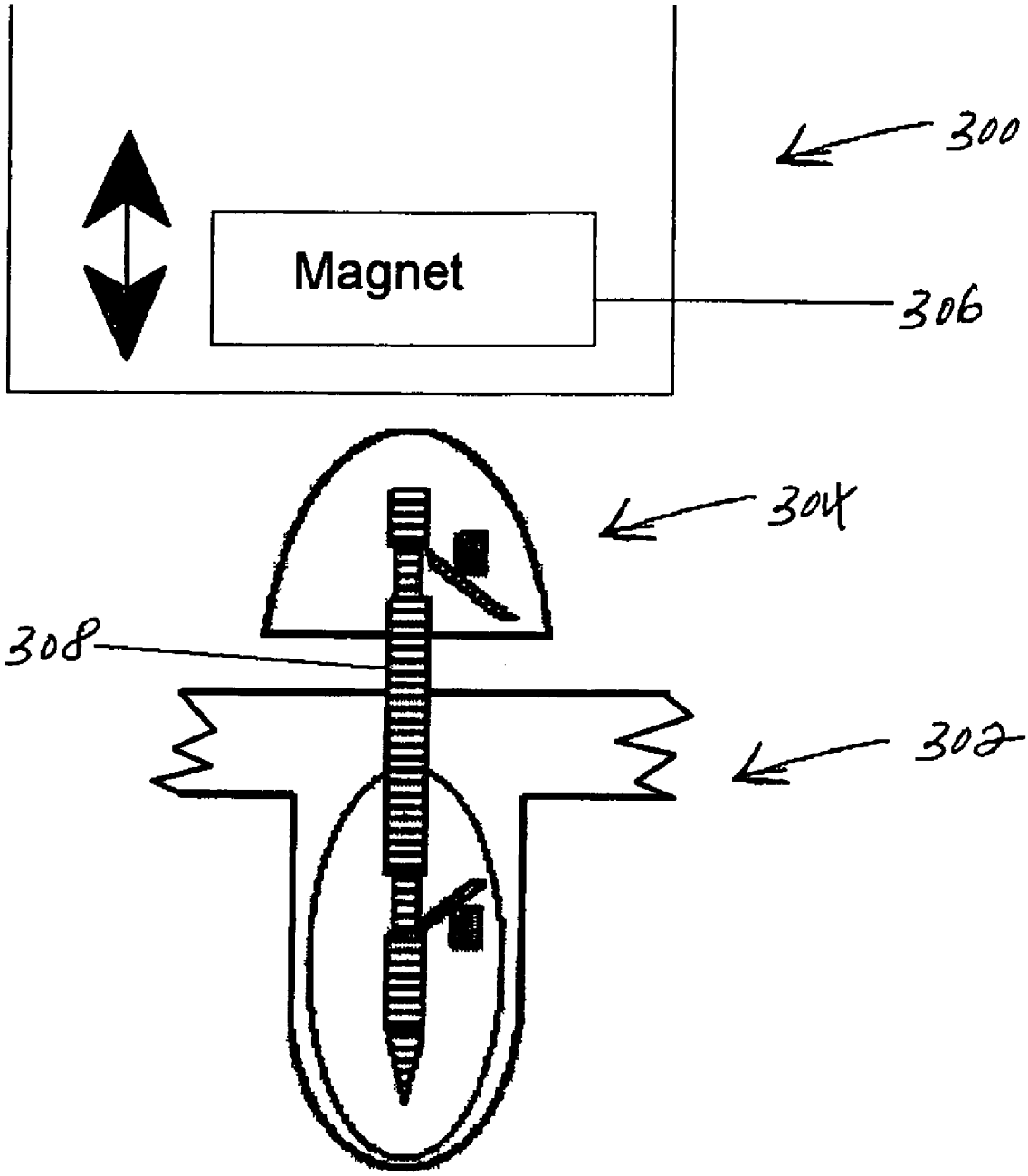
FIG. 4 schematically depicts an embodiment of a detacher system consistent with the present disclosure.

Turning to FIG. 4, according to another aspect contemplated herein, a detacher system 300 may be provided including a magnet 306 that may disengage the button 304 or tag 302 from the blunt end of the pin 308 and/or remove the button 304 or tag 302 from the pin 308. A detacher 300 may include a magnet 306 that may be brought into proximity with the button 304 to release a magnetically disengageable clutch located in the button 304. The button 304 may be retained to the magnet 306 by magnetic attraction between the magnet 306 and ferrous components of the button 304, such as the ferrous plunger, ball bearings, etc. Accordingly, when the magnet 304 is retracted from the identification/surveillance device the button 304 may be removed from the pin 308 and retracted along with the magnet 306. In a related embodiment, once the magnetic clutch has been disengaged the button may be swept from the magnet or blown from the magnet, e.g., using compressed air, etc. The magnet may be configured to be selectively magnetizable, e.g., an electromagnet. The magnet may disengage the button from the pin and the button may be retained to the magnet. The magnet may subsequently be demagnetized to release the button allowing the button to be collected, e.g., in a bin or container. Consistent with these embodiments, the removed buttons may be readily deposited in a collection bin or container.

Figure 5:
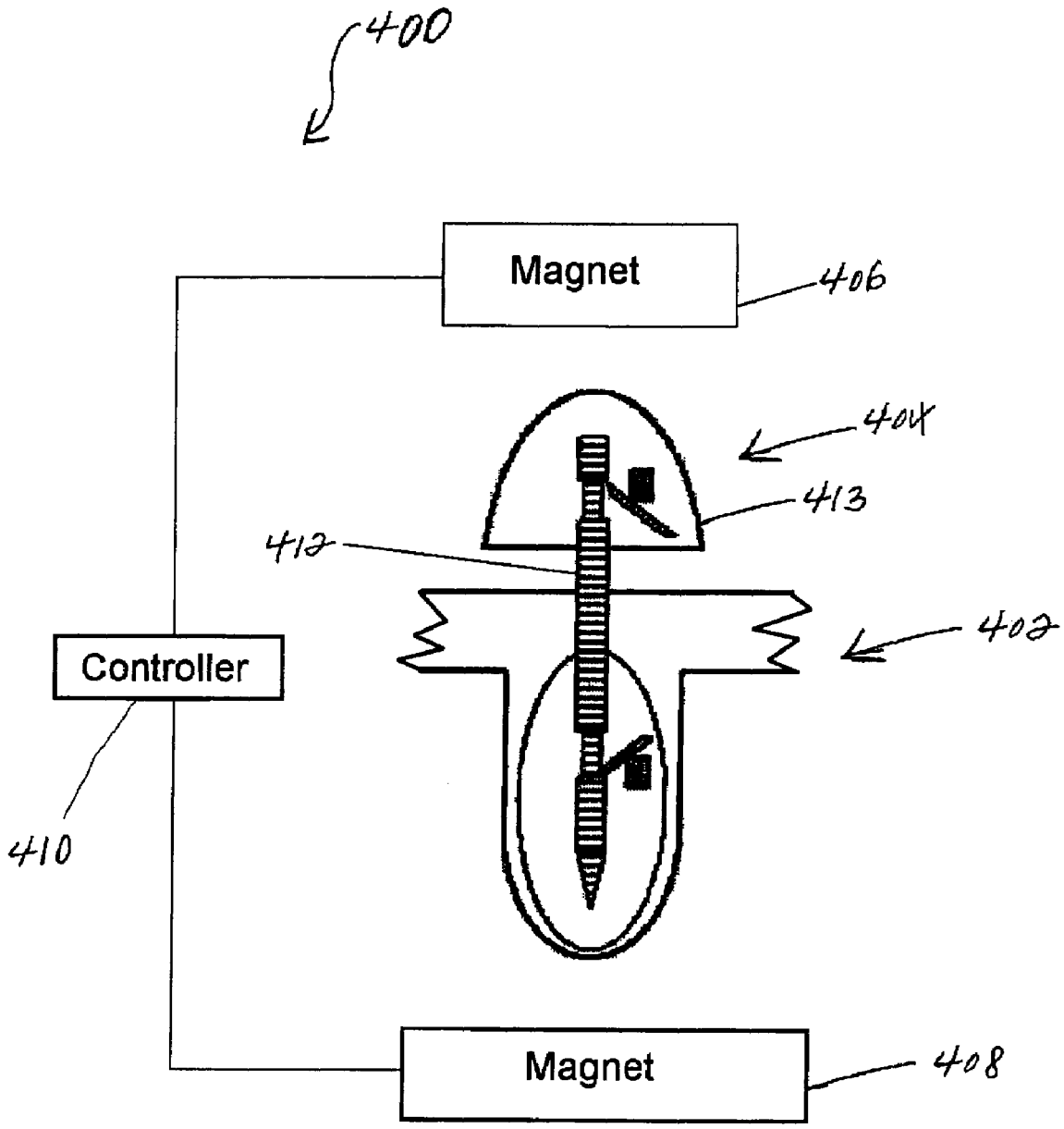
FIG. 5 schematically illustrates another embodiment of a detacher system consistent with the present disclosure.

According to yet another aspect, depicted in FIG. 5, a detacher system 400 may be provided that may either remove the tack 404 as a single unit or may only remove the button 413 and leave the pin 412 engaged with the tag 402. For example, the pin 412 may be releasably engaged to the button 413 and may be releasably engaged to the tag 402. The detacher system 400 may include a first magnet 406 that may be selectively moved into a position proximate to the button 413. When the first magnet 406 is moved into the position proximate to the button 413, a magnetic clutch in the button 413 may be disengaged, thereby allowing the button 413 to be removed from the pin 412. In one embodiment, when the button 413 is removed from the pin 412 a blunt end of the pin may be exposed. Such a detachment mechanism may be especially suitable for self-checkout.

The detacher system 400 may also include a second magnet 408 that may be selectively moveable to a position proximate to the tag 402. When the second magnet 408 is moved into to position proximate to the tag 402, the second magnet 408 may disengage a magnetic clutch in the tag 402 releasing the tack 404 from the tag 402. When the clutch in the tag 402 has been disengaged the tack 404, including the button 413 engaged to the pin 412, may be removed from the tag 402 thereby exposing the sharp end of the pin 412. As the tack 404 in its entirety is removed from the tag 402, the tack 404 may be in a condition to be reused without having to first assemble a pin 412 to the button 413. Such a detachment mechanism may be suitable for use by trained employees at an assisted checkout station of a retail establishment.

Consistent with the foregoing aspect, a single detacher system 400 may be provided that may be suitable both for self-checkout and for assisted checkout. The detacher system 400 may include a controller 410 to allow the mode of operation may be selected manually, e.g., based on whether the checkout station is a self-checkout station or an assisted checkout station. Alternatively, or additionally, the mode of detachment may be automatically selected. Additionally, the first and/or the second magnets may be electromagnets rather than permanent magnets. Accordingly, rather than moving the first or the second magnet to a position proximate the button or the tag, the controller 410 may instead provide an electronic signal to enable a power supply to energize the appropriate electromagnet for the selected detachment mode.

The system may also include means for forcing the pin 412 into the tag 402 or the button 413 after the button or tag has been removed. In one embodiment wherein the button 413 is removed to expose the blunt end of the pin, the pin 412 may be forced axially into the tag 402 so that no portion of the pin extends outward from the tag, thereby eliminating any pricking hazard and/or any interference to the tag removal process associated with the blunt end of the pin. The pin 412 may be drawn or pushed into the tag 402 or button 413 by mechanical and/or electro-mechanical means. For example, the magnet 408 may be configured to attract the pin into the tag 402, or the magnet 406 may be configured to attract the pin into the button 413.

While particular embodiments of clutches and/or clamps for engaging the pin have been described herein, various other clutch and/or clamp designs and configurations may be employed for releasably engaging the button and the pin and for releasably or non-releasably engaging the tag and the pin. Additionally the clutches and clamps disclosed herein are susceptible to numerous modifications and variations. For example, rather than using magnetic disengagement configurations, the clutch designs disclosed herein may be configured to utilize a mechanical-based release or disengagement. Various other modifications and variations will be apparent to those having skill in the art.

The embodiments that have been described herein are but some of the several which utilize this invention and are set forth here by way of illustration but not of limitation. It is obvious that many other embodiments, which will be readily apparent to those skilled in the art, may be made without departing materially from the spirit and scope of the invention as defined in the appended claims.

What is claimed is:

1. An identification/surveillance device for an article comprising:

a tags, said tag having a detectable device located therein;

a tack;

a pin comprising a first end and a second end, said first end being sharper than said second end, said tack and said tag each capable of being joined to one another by said pin; and a clutch mechanism located within either said tag or said tack for releasably engaging said second end of said pin, wherein one of said tag or said tack further comprises another clutch mechanism adapted to non-releasably engage with said first end of said pin.

2. A device according to claim 1, wherein at least one of said clutch mechanisms comprises a magnetically disengageable clutch.

3. A device according to claim 1, wherein at least one of said clutch mechanisms comprises at least one ball bearing configured to engage an associated feature on said pin.

4. A device according to claim 3, wherein said at least one of said clutch mechanisms comprises a spring biasing said at least one ball bearing toward an engaged configuration.

5. A device according to claim 4, wherein said spring acts through a plunger to bias said at least one ball bearing toward an engaged configuration.

6. A device according to claim 5, wherein said plunger comprises a ferrous body.

7. A device according to claim 1, wherein at least one of said clutch mechanisms comprises a locking member and a resiliently deformable member biasing said locking member toward a locked configuration.

8. A device according to claim 7, wherein said locking member comprises a ferrous member.

9. A device according to claim 1, wherein one of said tag or said tack comprises an EAS device.

10. A device according to claim 1, wherein one of said tag or said tack comprises an RFID device.

11. A device according to claim 1, wherein one of said tag or said tack comprises a marking device.

12. A device according to claim 1 wherein the second end of the pin has a flat end surface.

13. A device according to claim 1 wherein the first end of the pin is tapered.

14. A device according to claim 1 wherein said tack comprises a button and said second end of said pin is releasably engaged to said button by means of said clutch mechanism located within said button.

15. A method of identifying/surveilling an article comprising:

providing a pin having a first end and a second end, said first end being sharper than a second end of said pin;

providing a button having a first clutch mechanism disposed therein for releasably engaging said second end of said pin;

providing a tag having a second clutch mechanism disposed therein for releasably engaging said first end of said pin;

engaging said second end of said pin with said first clutch mechanism located in said button to form a tack;

inserting said first end of said pin through said article; and engaging said first end of said pin with said first clutch mechanism located in said tag.

16. A device according to claim 1, wherein said clutch mechanism is a clamp configured to capture said first end of said pin.

17. A device according to claim 16, wherein said clamp comprises a member defining an elastically expandable opening sized to non-releasably engage a radial groove in said pin.

* * * * *